US006503460B1

(12) United States Patent
Miller et al.

(10) Patent No.: US 6,503,460 B1
(45) Date of Patent: Jan. 7, 2003

(54) STAGED CATALYST REGENERATION IN A BAFFLED FLUIDIZED BED

(75) Inventors: Richard B. Miller, Katy, TX (US); Yong-Lin Yang, Katy, TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 0 days.

(21) Appl. No.: 09/271,417

(22) Filed: Mar. 17, 1999

(51) Int. Cl.[7] ..... B01J 8/18; B01J 8/24; B01J 8/34; B01J 8/44

(52) U.S. Cl. ..... 422/143; 422/139; 422/141; 422/142; 422/144; 422/145; 432/58

(58) Field of Search ..... 422/145, 144, 422/223, 140, 139, 141, 142, 143; 110/245; 432/58

(56) References Cited

U.S. PATENT DOCUMENTS

| | | | | |
|---|---|---|---|---|
| 2,581,134 | A | * | 1/1952 | Odell |
| 2,944,009 | A | * | 7/1960 | Huntley et al. |
| 3,785,620 | A | | 1/1974 | Huber |
| 4,051,069 | A | | 9/1977 | Bunn, Jr. et al. |
| 4,150,090 | A | | 4/1979 | Murphy et al. |
| 4,313,848 | A | * | 2/1982 | Scott |
| 4,615,992 | A | | 10/1986 | Murphy |
| 4,888,156 | A | | 12/1989 | Johnson |
| 5,156,817 | A | | 10/1992 | Luckenbach |
| 5,462,717 | A | * | 10/1995 | Pfeiffer ..... 422/146 |
| 5,635,140 | A | | 6/1997 | Miller et al. |
| 5,773,378 | A | | 6/1998 | Bussey et al. |

FOREIGN PATENT DOCUMENTS

| | | |
|---|---|---|
| EP | 0622116 | 11/1994 |

OTHER PUBLICATIONS

"FCC Regererator Flow Model"; Sapre, A.V., Leib, T.M. and Anderson, D.H.; *Chemical Engineering Science*, vol. 45, No. 8, pp. 2203–2209 (1990).

"Comparison Between Single and Two–Stage FCC Regenerators"; Miller, R.B. Johnson, T.E., Santner, C.R., Avidan, A.A., and Beech, J.H.; 1996 NPRA Annual Meeting, Paper #AM–96–48, p. 2.

* cited by examiner

*Primary Examiner*—Jerry D. Johnson
*Assistant Examiner*—Alexa A. Doroshenk
(74) *Attorney, Agent, or Firm*—Kellogg Brown & Root, Inc.

(57) ABSTRACT

Staged combustion in a single regenerator of a FCC unit is disclosed. The regenerator has a spent catalyst distributor at the top of the catalyst bed, and an air grid at the lower end of the bed. A baffle separates the catalyst bed into upper and lower stages. Excess oxygen is present in the lower bed; partial CO combustion mode is maintained in the upper bed. The baffle inhibits backmixing flux to achieve sufficient staging to burn the catalyst clean under partial CO combustion. This achieves a clean burn of the catalyst in a single regenerator vessel in the partial CO combustion operating mode. Surprisingly, the baffle also reduces catalyst entrainment in the dilute phase, thereby cutting particulate emissions from the regenerator and reducing cyclone wear.

37 Claims, 6 Drawing Sheets

STAGED CATALYST REGENERATION IN A BAFFLED FLUIDIZED BED

FIELD OF THE INVENTION

The present invention relates to catalyst regeneration in fluidized catalytic cracking units, more particularly to a regenerator system employing a baffled fluidized bed for two-stage catalyst regeneration.

BACKGROUND OF THE INVENTION

Improvements in fluid catalytic cracking (FCC) technology have continued to make this conventional workhorse process more reliable and productive. In recent years, much of the activity in FCC development has focused on the reaction side of the process. However, the importance of improving regenerator design has increased as more refiners process resid-containing feedstocks and as environmental restrictions on emissions become tighter.

Continuous catalyst regeneration is a key element of the FCC process. It continuously restores catalytic activity by combusting the coke deposited on the catalyst and it provides the heat required for the process. In FCC units processing high-resid feedstocks, the re-generator must also remove excess heat generated by the high coke make caused by contaminants in the feed.

Ideally, the regeneration system accomplishes these goals in an environment that preserves catalyst activity and selectivity so that catalyst makeup is minimized and reactor yields are optimized. Environmental regulations on particulate and $NO_x$ emissions impose additional constraints. The ideal regeneration system would regenerate catalyst uniformly to low carbon levels, minimize catalyst deactivation, reduce vanadium mobility and limit catalyst poisoning, reduce particulate emissions, provide operational flexibility, offer high mechanical reliability, and minimize complexity and capital cost. An important principle in regenerator design is to minimize the size and mechanical complexity of the regenerator and its internals, consistent with meeting the process performance criteria.

FCC units processing high-resid feedstocks need to deal effectively with heavy feed components rich in nickel, vanadium, and Conradson Carbon Residue (CCR). While each of these contaminants affects the performance of the unit in different ways, the latter two present significant challenges to the design of the regenerator. CCR in the feed increases the coke make and can lead to excessively high regenerator temperatures. Heat must be removed from the system to achieve acceptably high catalyst-to-oil ratios and avoid exceeding regenerator metallurgy temperature limits. One option is to limit the heat release in the regenerator by operating in a partial CO combustion mode. The heat of CO combustion is released in a downstream CO boiler. Another option is to install a catalyst cooler. The excess heat is directly removed from the catalyst and is used to generate high-pressure steam.

Although nickel and vanadium both deposit quantitatively on the catalyst, nickel forms stable compounds which remain on the outer surface of the catalyst. The oldest catalyst particles contain the highest levels of nickel. Vanadium is much more destructive than nickel. In the presence of high temperatures, excess oxygen, and steam, it redistributes over the entire catalyst inventory, contaminating both new and old catalyst and destroying catalyst activity. This phenomenon reduces the equilibrium activity of the unit inventory because most of the catalytic activity is derived from the newest catalyst particles. The reactions characterizing vanadium mobility are as follows:

$V_2O_5$ generated in oxidative environment:

$$4\ V+5O_2 \rightarrow 2V_2O_5$$

Migration to other particles via volatile vanadic acid:

$$V_2O_5+3H_2O \rightarrow 2VO(OH)_3$$

To mitigate these effects, it is wise to design for partial combustion of CO in the regenerator when processing feedstocks with high vanadium and CCR contents. By restricting vanadium mobility, premature deactivation of the fresh catalyst is prevented and the catalyst equilibrates at a higher activity for a given metal level.

Operating the regenerator in partial CO combustion mode is an attractive option because it (1) reduces catalyst makeup rate by limiting vanadium mobility in the regenerator and vanadium-induced deactivation of the catalyst; (2) can eliminate the need for a catalyst cooler when processing moderately contaminated feeds, or it can reduce the size of the catalyst cooler required for heavily contaminated feeds; (3) reduces the size of the regenerator vessel and air blower; and (4) reduces NOx emissions.

Unfortunately, there are drawbacks as well. In a partial combustion operation, it is difficult to burn all of the carbon off the catalyst. Residual carbon can have a negative effect on catalyst activity. (For the purposes of the present specification and claims, we will define "cleanly burned catalyst" as containing $\leqq$0.1 wt % carbon.) At a $CO_2$/CO ratio of about 3.5:1, the regenerated catalyst from a conventional single-stage regenerator may contain 0.15–0.25% carbon. FIG. 1 shows the relationship between catalyst activity and carbon-on-regenerated-catalyst. In this example, dropping the carbon level from 0.25% to 0.10% increases the MAT activity by about 3–4 vol % (per ASTM D-3907).

One way to achieve the goal of burning the catalyst clean in partial combustion operation is to utilize what is referred to in the art as two-stage regeneration. In this type of design, multiple regenerator vessels are operated in series with either cascading or separate flue gas trains. The first stage operates in partial combustion and the second stage operates in complete combustion. While they can achieve low levels of carbon-on-catalyst, these two-stage designs are more mechanically complex, more expensive, and more difficult to operate than a single-stage regenerator.

U.S. Pat. No. 4,615,992 to Murphy discloses a horizontal baffle device or subway grating 2 to 4 feet below the catalyst bed level in a regenerator operating in complete combustion mode. The baffle device is said to eliminate the need for catalyst distribution troughs and aerators.

Other U.S. Patents of interest include U.S. Pat. No. 3,785,620 to Huber; U.S. Pat. No. 4,051,069 to Bunn, Jr. et al.; U.S. Pat. No. 4,150,090 to Murphy et al.; U.S. Pat. No. 4,888,156 to Johnson; U.S. Pat. No. 5,156,817 to Luckenbach; U.S. Pat. No. 5,635,140 to Miller et al.; and U.S. Pat. No. 5,773,378 to Busey et al. EPA 94-201,077 discloses radial distribution of fluid into a catalyst bed in a regenerator vessel.

SUMMARY OF THE INVENTION

We have invented a regeneration system which achieves complete removal of carbonaceous deposits from spent fluid catalytic cracking catalyst in a single regeneration vessel while operating in an environment of incomplete combustion which could only be accomplished in the prior art by using multiple regenerator vessels. Furthermore, our system reduces entrainment of catalyst into the dilute phase of the regenerator, thus reducing particulate emissions and mechanical wear on the regenerator cyclones. These benefits are achieved by placing a baffle in the regenerator to reduce backmixing between the upper and lower sections of the fluidized bed. A spent catalyst distributor, which evenly distributes catalyst across the top of the upper bed is also an important part of the invention.

In one aspect, the present invention provides a catalyst regenerator for removing carbon from fluid catalytic cracking (FCC) catalyst circulated in a FCC unit. The regenerator includes a vessel comprising a dilute phase and a dense phase fluidized catalyst bed disposed in respective upper and lower regions of the vessel. A spent catalyst distributor is provided for distributing spent catalyst feed preferably radially outwardly from a central pipe or well, into the vessel adjacent a top of the dense phase fluidized catalyst bed. An air grid is disposed adjacent a bottom of the dense phase fluidized catalyst bed for introducing oxygen-containing aeration fluid into the vessel. A baffle is disposed between the spent catalyst distributor and the air grid. The baffle can divide the dense phase bed into upper and lower stages, wherein aeration fluid leaving the upper stage contains CO and is essentially free of molecular oxygen and aeration fluid leaving the lower stage contains molecular oxygen and is essentially free of CO. Preferably, at least 40 percent, and more preferably at least 60 percent, of the catalyst in the dense phase fluidized catalyst bed, is disposed above a vertical midpoint of the baffle. The backmixing flux of the catalyst up through the baffle is preferably approximately equal to or less than the net or bulk flux of the catalyst down through the baffle. A line is connected to an upper region of the vessel for discharging aeration fluid from the dilute phase. A line is connected to a lower region of the vessel for withdrawing regenerated catalyst from the dense bed.

Preferably, the discharged aeration fluid contains CO and is essentially free of molecular oxygen. The spent catalyst distributor can include a plurality of aerated trough arms radiating outwardly from the central pipe or well. The baffle is preferably a structured baffle made from corrugated angularly offset metal sheets. The baffle is preferably at least 6 inches thick, more preferably 2 feet or more.

In another aspect, the present invention provides a method for regenerating FCC catalyst circulated in a FCC unit. The method includes supplying spent FCC catalyst containing carbon deposited thereon to the spent catalyst distributor of the catalyst regenerator described above, and operating the catalyst regenerator in partial CO combustion mode. The midpoint of the baffle can divide the dense phase catalyst bed into upper and lower stages, wherein the lower stage is operated in an excess oxygen condition and the upper stage is operated in a partial CO combustion mode so that the discharged aeration fluid contains CO and is essentially free of molecular oxygen. The baffle and the spent catalyst distributor preferably inhibit backmixing between the upper and lower stages by at least about 80 percent. The operation of the catalyst regenerator can be essentially free of catalyst cooling. The regenerated catalyst withdrawn from the vessel preferably contains less than 0.05 weight percent carbon.

In a further aspect, the present invention provides a method for retrofitting a FCC unit catalyst regenerator comprising (1) a vessel comprising a dilute phase and a dense phase fluidized catalyst bed disposed in respective upper and lower regions of the vessel, (2) a spent catalyst distributor for distributing spent catalyst feed to the vessel adjacent a top of the dense phase bed, (3) an air grid disposed adjacent a bottom of the dense phase bed for introducing oxygen-containing aeration fluid into the vessel, (4) a line connected to an upper region of the vessel for withdrawing aeration fluid, and (5) a line connected to a lower region of the vessel for withdrawing regenerated catalyst. The retrofit method includes installing a baffle in the dense phase bed below the spent catalyst distributor and above the air grid, and operating the catalyst regenerator with at least 40 percent, preferably at least 60 percent, of the catalyst in the dense phase bed above a vertical midpoint of the baffle.

The catalyst regenerator can be operated in complete combustion mode prior to the retrofit and in partial CO combustion mode thereafter. The catalyst regenerator can be operated in conjunction with a catalyst cooler prior to the retrofit and without the catalyst cooler thereafter. The catalyst regenerator can be operated prior to and after the retrofit to obtain regenerated catalyst containing less than 0.05 weight percent carbon. The catalyst makeup rate is preferably less after the retrofit. The $NO_x$ in the discharged aeration fluid is preferably less after the retrofit. The catalyst entrainment in the dilute phase is preferably less after the retrofit. The method can also include installing a downstream CO burner to convert the CO in the withdrawn aeration fluid to $CO_2$. The feedstock supplied to the FCC unit can have a higher resid content after the retrofit.

DETAILED DESCRIPTION OF THE INVENTION

Figure 2:
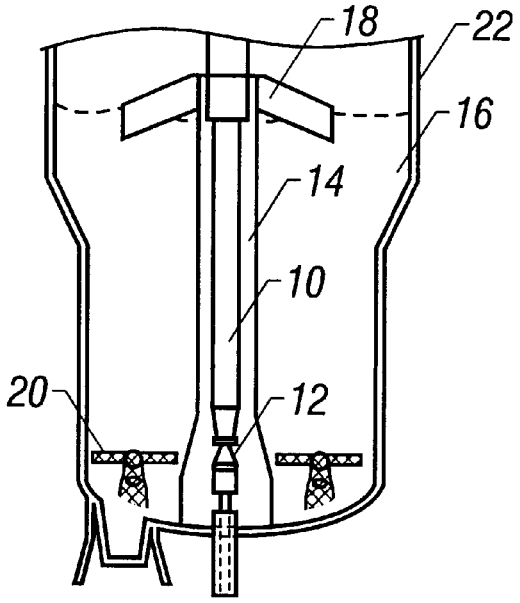
FIG. 2 (PRIOR ART)
FIG. 2 (prior art) depicts a lower portion of a typical regenerator for burning coke from a spent FCC catalyst.
Figure 4:
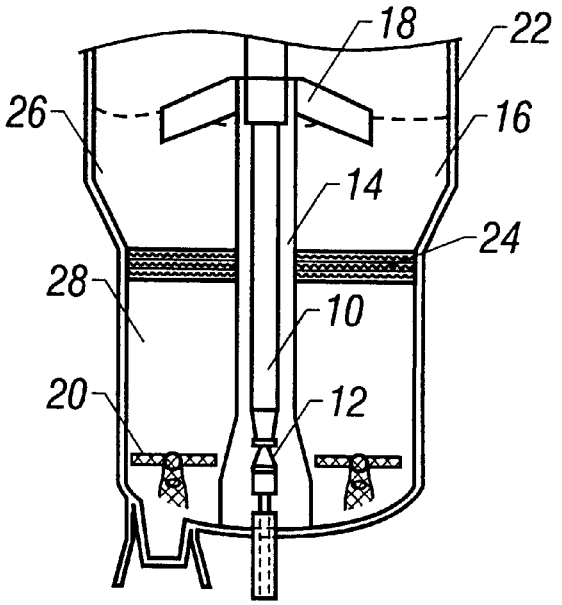
FIG. 4 shows the regenerator of FIG. 2 modified to include the baffle according to one embodiment of the present invention.
Figure 3:
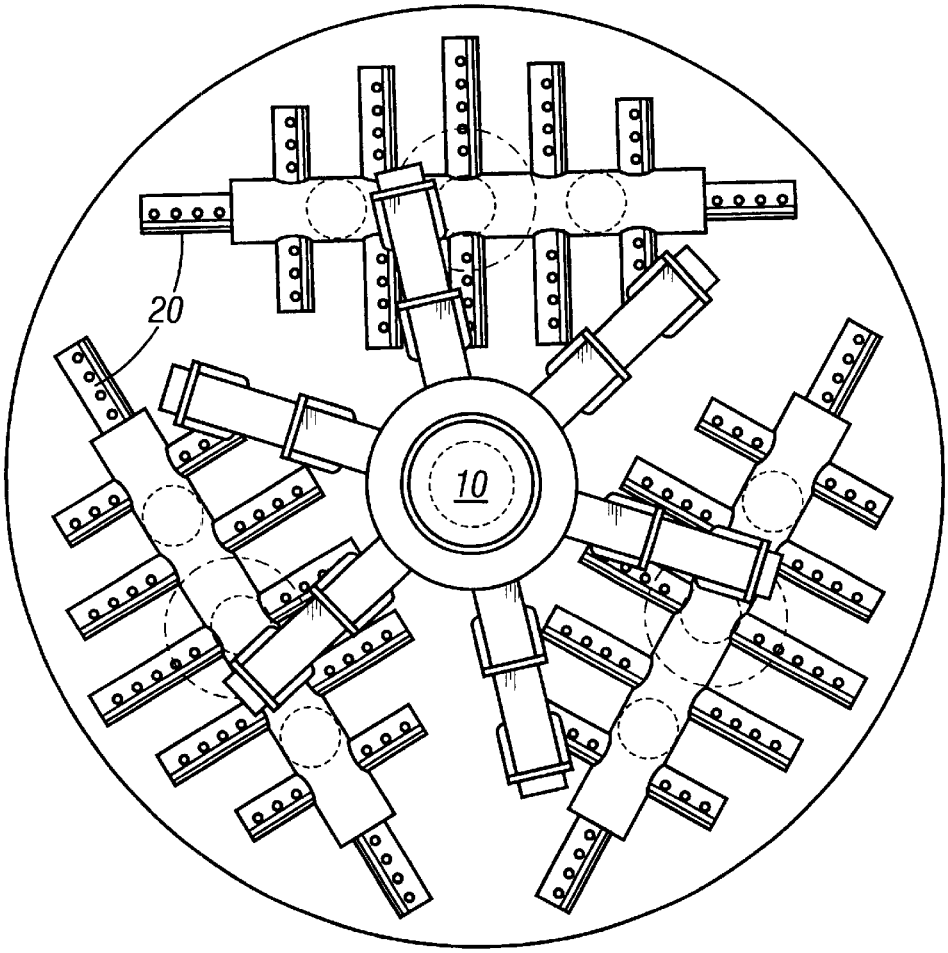
FIG. 3 (prior art) is a plan view of the regenerator of FIG. 2.
Figure 7:
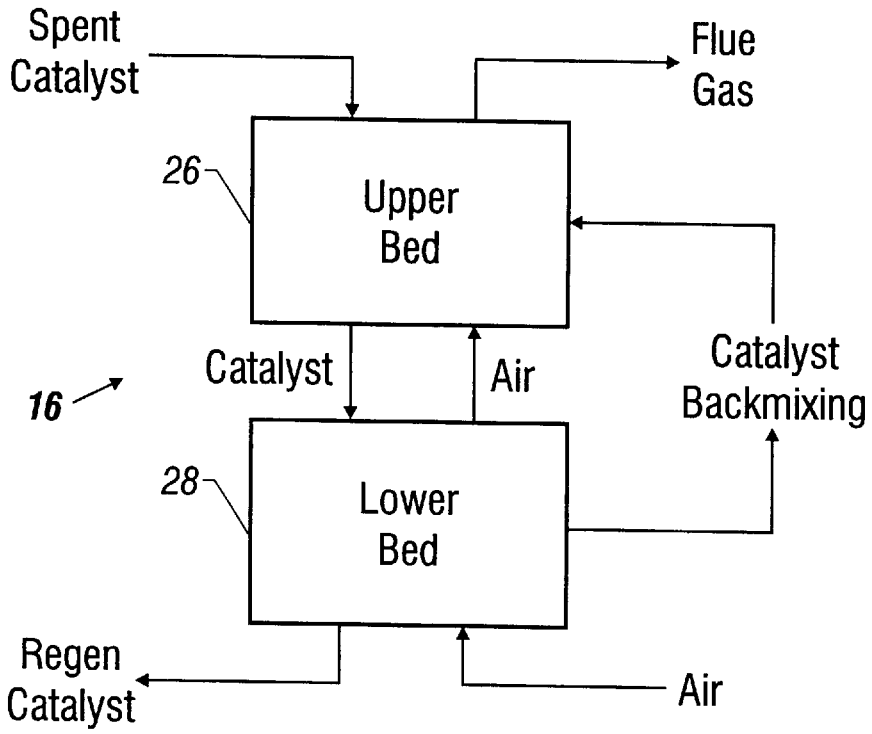
FIG. 7 is a simplified flow diagram of catalyst regeneration for kinetic modeling of the two-stage baffled regenerator according to one embodiment of the present invention.
Figure 8:
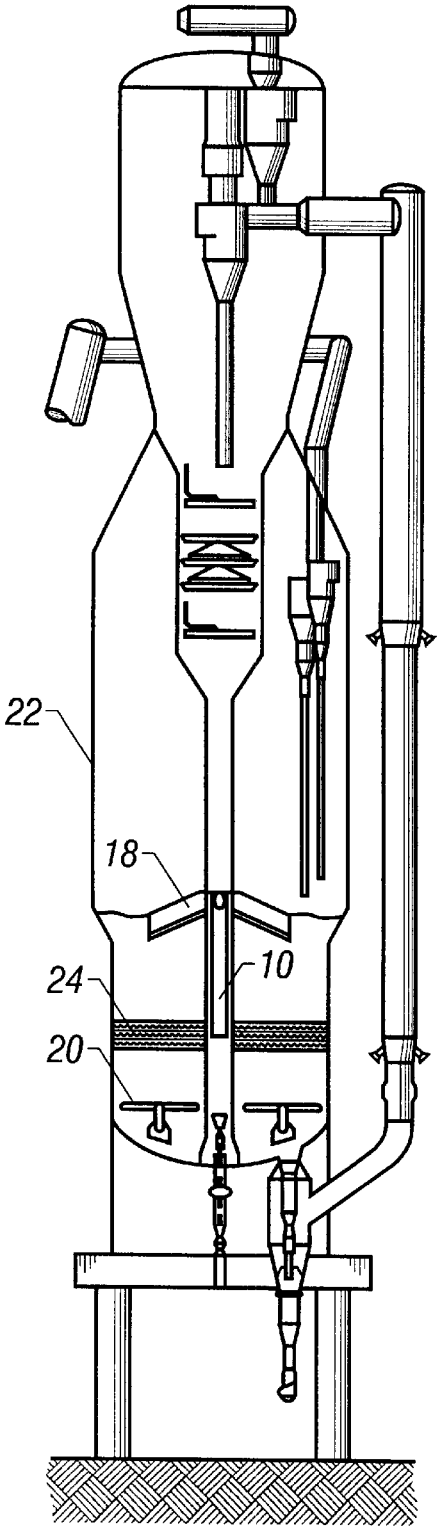
FIG. 8 shows a FCC unit with the regenerator disposed directly beneath the stripper modified with a regenerator baffle according to one embodiment of the invention.

The present invention is an apparatus and process for regenerating spent catalyst. With reference to FIGS. 2–4, both the prior art and the present invention regenerator include a standpipe 10 and plug valve 12. Spent catalyst from a conventional stripper (see FIGS. 7 and 8) flows down the standpipe 10 and passes through the catalyst plug valve 12. After passing through the plug valve 12, the catalyst changes direction and flows upwardly through the annulus of the spent catalyst centerwell 14 using air as a fluidization media. The catalyst is then distributed evenly onto the top of the dense phase catalyst bed 16 via multiple spent catalyst distributor trough arms 18. The dense fluidized bed 16 is aerated by air provided by the main combustion air grids 20 which are conventional in the art. As the aeration air travels upward from the grids 20 through the dense phase bed 16, the carbon on the catalyst is burned to form CO and/or $CO_2$. Off gas is conventionally recovered overhead from the regenerator 22 via separator cyclones and an overhead line (see FIGS. 7 and 8). Typically, when the regenerator 22 is operated in a partial CO combustion mode, the line will be connected to a conventional CO burner (not shown) to convert the CO to $CO_2$ before discharge to the atmosphere.

Figure 6:
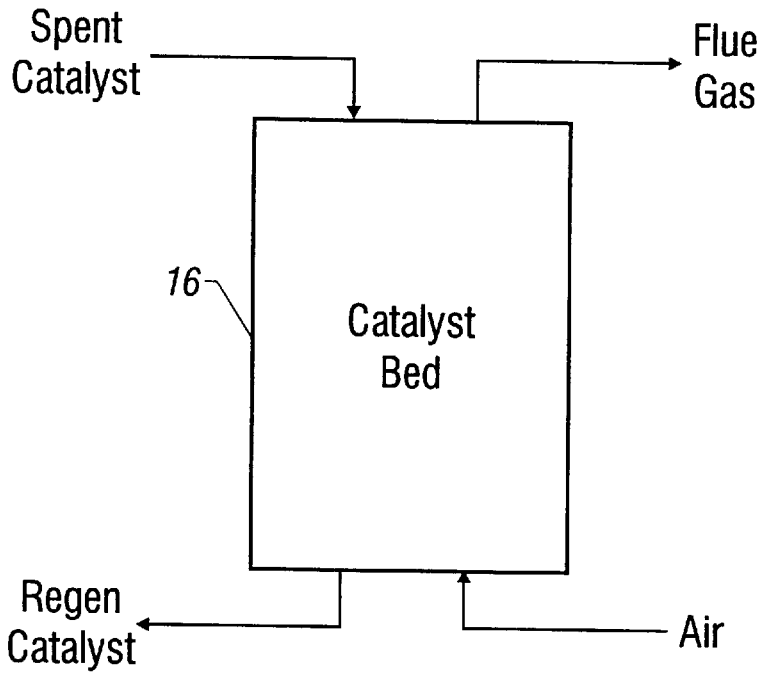
FIG. 6 (PRIOR ART)
FIG. 6 (prior art) shows a simplified flow diagram of catalyst regeneration for kinetic modeling of the prior art catalyst regenerator.

According to the principles of the present invention, a baffle 24 is positioned to divide the catalyst bed 16 into an upper stage 26 and a lower stage 28. (See FIG. 4). The operating differences between the single stage catalyst regeneration in the prior art regenerator 22 of FIG. 2, as compared to the two-stage regeneration in FIG. 4, is seen by comparing the flow diagrams of FIGS. 6 and 7. In FIG. 6, spent catalyst is introduced to catalyst bed 16 which is generally modeled as a continuously stirred tank reactor (CSTR). Flue gas is obtained overhead. Air is introduced at the bottom of the catalyst bed 16 and regenerated catalyst is withdrawn therefrom. In the two-stage operation according to the present invention (FIG. 7), spent catalyst is introduced to the top of upper stage 26 which is separated from lower stage 28 by the baffle 24 (see FIG. 4). Flue gas is obtained overhead from the upper stage 26. Regenerated catalyst is withdrawn from a bottom of the lower stage 28 and air is introduced to the bottom of the lower stage 28 as in the unbaffled version. However, the upper stage 26 is separated from the lower bed by the baffle 24. Catalyst travels from the upper stage 26 to the lower stage 28, and air travels from the lower stage 28 to the upper stage 26 through the baffle 24. The model includes catalyst backmixing allowing for some catalyst to travel from the lower stage 28 back to the upper stage 26.

The combination of the baffle 24 and spent catalyst distributor trough arms 18 preferably inhibits backmixing of catalyst from the lower stage 28 to the upper stage 26 by at least about 80 percent compared to the unbaffled bed 16. This produces true staged combustion. The counter-current configuration of conventional regenerators provides enough staging effect to minimize catalyst particle temperature rise and associated deactivation, but the backmixing between the upper and lower portions of the bed is too high to permit true staged combustion. With reference to FIG. 6, as the backmixing flux approaches infinity, the regenerator 22 approaches single-stage CSTR operation (see FIG. 5). As the catalyst backmixing flux approaches zero, the regenerator 22 approaches true two-stage operation (see FIG. 6).

Figure 5:
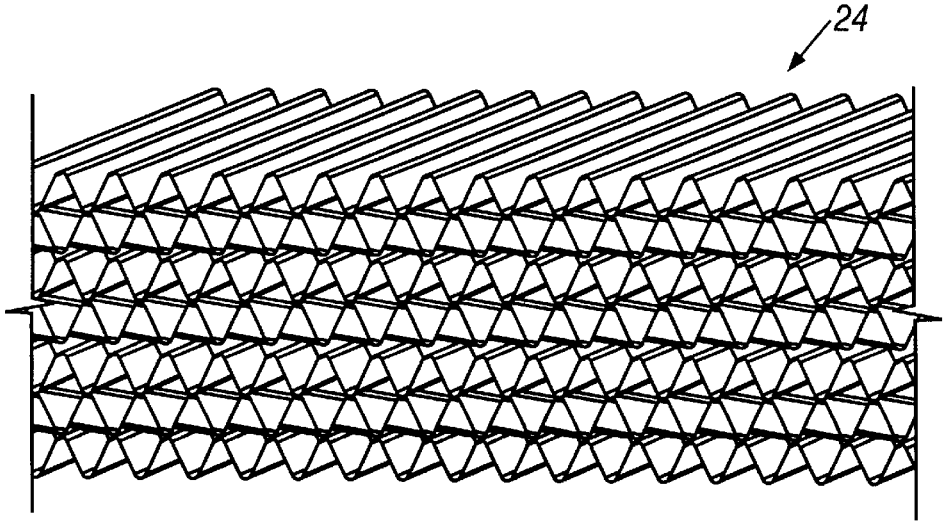
FIG. 5 is an enlarged top view of a section of the baffle of FIG. 4.

Any suitable baffle construction may be used for the baffle 24, provided that it sufficiently inhibits backmixing to obtain two-stage operation of the regenerator 22, such as, for example, simple baffle(s), shed deck(s) or the like. As used in the present specification and claims, "inhibiting backmixing" means that backmixing is reduced relative to operation of the regenerator 22 without the baffle 24, but still using the spent catalyst distributor and trough arms 18. A particularly preferred construction of the baffle 24 employs one or more packing elements composed of corrugated lamellas wherein the corrugations of adjacent lamellas are oriented in different directions, preferably plus 45 degrees and minus 45 degrees from vertical, as seen in FIG. 5. These preferred baffle materials are conventionally used for static mixing and are described in U.S. Pat. No. 3,785,620 to Huber which is hereby incorporated herein by reference in its entirety. The baffle 24 is preferably at least 6 inches thick, more preferably at least 1 foot thick and especially at least 2 feet thick. The thicker baffle helps inhibit backmixing and reduces the catalyst entrainment rate in the regenerator. Generally, a larger regeneration bed calls for a thicker baffle.

The baffled regenerator bed should be designed for a superficial vapor velocity of between 0.5 and 7 ft/s, preferably between 2 and 5 ft/s, and especially between 2.5 and 3.5 ft/s. Higher superficial vapor velocity would increase the vertical backmixing rate and could result in not burning the catalyst clean.

The spent catalyst distributor can be any conventional device employed for this purpose, but is preferably an aerated catalyst distributor. A particularly preferred self-aerating catalyst distributor is described in U.S. Pat. No. 5,635,140 to Miller et al. which is hereby incorporated herein by reference in its entirety. Briefly, the Miller et al. distributor includes a plurality of perforated trough arms 18 radiating outwardly from the centerwell 14, wherein the trough arms 18 have downwardly projecting contiguous lips to capture aeration air and buoyant forces force the captured aeration air through the perforations into the trough. We prefer to use 6–8 trough arms 18.

The bed split ratio, i.e. the ratio of catalyst in the upper stage 26 to the lower stage 28, using the vertical midpoint of the baffle 24, should be at least 40 percent upper/60 percent lower, more preferably at least 60 percent upper/40 percent lower, and especially 65 percent upper/35 percent lower. In general, with a larger inventory in the upper stage 26 the regenerator 22 is more easily operated and has the flexibility to handle upsets or sudden variations in the spent catalyst feed rate to the regenerator 22. The inventory of catalyst in the upper stage needs to be sufficiently high to sustain the burn rate of the catalyst; if the catalyst inventory in the upper stage is too low, it is more difficult to maintain combustion. Beyond this, we have also found that the greater the inventory in the upper stage, generally less inhibition of backmixing is required to obtain cleanly burned catalyst. For example, at a bed split ratio of 50 percent upper/50 percent lower, a 90 percent inhibited backmixing flux may be required to burn the catalyst clean, whereas with a bed split ratio of 65 percent upper/35 percent lower, a 73 percent inhibited backmixing flux might be tolerated.

In the operation of the regenerator 22, a low ratio of $CO_2$/CO in the flue gas coming from the upper stage 26 is advantageous because it reduces heat release and consequently reduces the regenerator temperatures. On the other hand, operating the regenerator 22 in partial combustion mode, a lower $CO_2$/CO ratio can result in an increase in the amount of carbon residue left on the catalyst. In general, the lower the $CO_2$/CO ratio, the less catalyst cooling which is required. In the preferred embodiment, the catalyst cooler can be eliminated altogether. On the other hand, the higher the $CO_2$/CO ratio, the more backmixing flux which can be tolerated across the baffle 24 and still obtain a clean burn. Typically $CO_2$/CO ratios vary from 2 or less up to about 6, more preferably from 2.5 to 4. We have also found that increasing the catalyst inventory in the regenerator 22, and using a deeper bed 16 with a smaller cross-sectional diameter helps to achieve a cleaner burn.

The regenerator 22 can be operated with or without a CO promoter, typically a catalyst such as platinum which is commonly added to promote the conversion of CO to $CO_2$. Preferably the regenerator 22 is operated without a CO promoter in the catalyst in order to facilitate low carbon on regenerated catalyst. We have found that operation without a CO promoter allows higher backmixing fluxes to be tolerated and/or a lower catalyst inventory/bed 16 height is possible.

It is also possible in the present invention, as mentioned previously, to completely eliminate the need for a catalyst cooler to cool catalyst in the regenerator 22. We have found that the catalyst can be easily burned clean in the two-stage operation of regenerator 22 at low or no catalyst cooler duty. On the other hand, cooling the catalyst helps to reduce the temperature of the bed 16 as well as the catalyst makeup rate. Catalyst cooling can also help to reduce the temperature difference between the upper stage 26 and lower stage 28. Typically, the regenerator is operated at 1250 to 1350° F., preferably from 1275 to 1325° F. In general, the catalyst cooler is not needed for processing feedstocks which produce medium or low delta carbon (e.g. ≦1 wt % delta carbon), but would be desirable for processing feedstocks which produce high delta carbon (e.g. 1.4 wt % delta carbon). "Delta carbon" is understood in the art as the change in the carbon content on the regenerated catalyst from the spent catalyst fed to the regenerator 22, expressed as a weight percent of the catalyst.

We have also found that the baffle 24 does not interfere with catalyst flow from the upper stage 26 to the lower stage 28, but it does restrict backmixing, i.e. flow from the lower stage 28 to the upper stage 26. There is no indication that the baffle 24 causes flooding or any other catalyst flow problems. Moreover, the density profiles are not affected by the baffle 24. The use of the baffle 24 allows a clean catalyst burn in partial combustion operation without an increase in catalyst inventory. This clean burn of the catalyst is achieved in a single, simple regenerator vessel, an accomplishment not possible with previous regeneration technologies. The use of the baffle 24 also reduces catalyst entrainment, reducing particulate emissions from the regenerator 22 and reducing wear on the regenerator cyclones.

The use of the baffle 24 also has the advantage of minimizing vanadium redistribution on the catalyst because the bed temperature can be kept around 1300° F. or lower and residence time in the presence of excess oxygen is minimized. Also, inhibiting backmixing between the upper stage 26 and lower stage 28 minimizes the presence of water vapor in the excess oxygen environment of the lower stage 28.

EXAMPLE 1

A small scale cold flow regenerator model having a height of 5 feet and a diameter of 8 inches was used to test the effect of the static-mixing-element baffle. Qualitatively, the small scale test showed that the baffle did not interfere with catalyst flow from the upper stage to the lower stage, but it did restrict backmixing. The small scale test also indicated that there was no flooding or other catalyst flow problem, and that the density profiles were not affected by the baffle.

EXAMPLE 2

Figure 9:
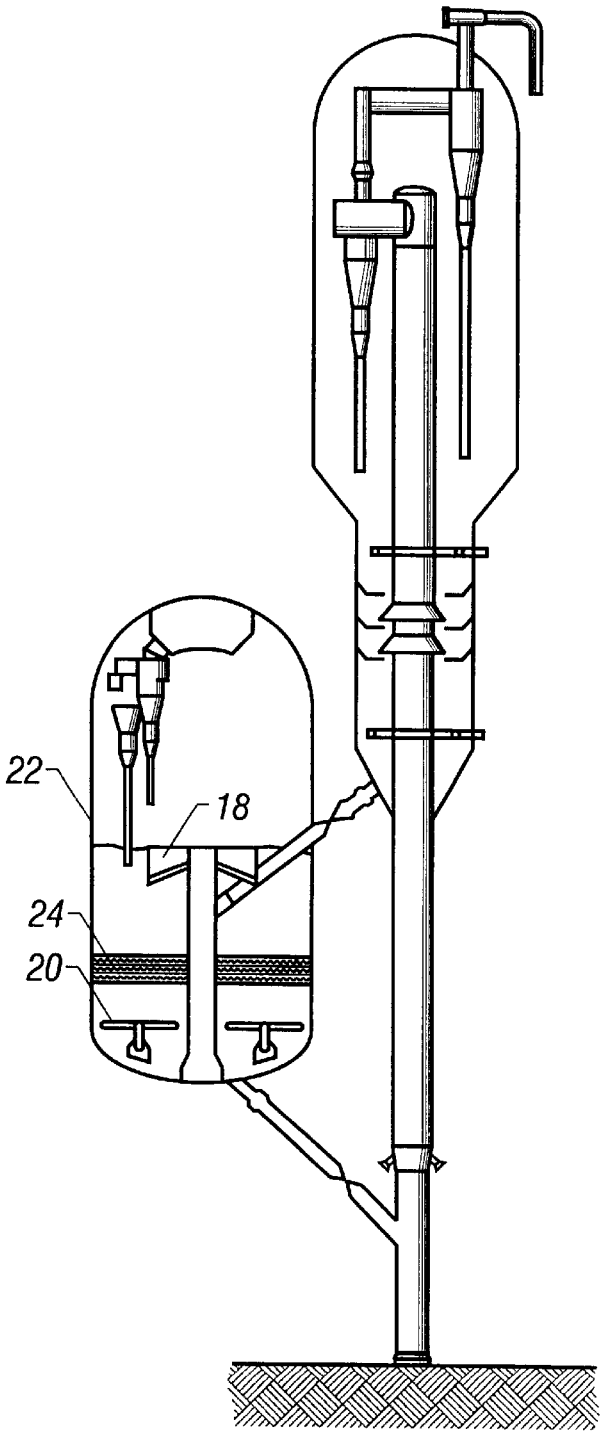
FIG. 9 shows a FCC unit with the regenerator disposed to one side of the stripper modified with a regenerator baffle according to an alternate embodiment of the invention.

A larger FCC cold flow model was built and operated to show regenerator performance. The regenerator had a 5-foot diameter, a bed height of 13 feet to 17 feet, held a catalyst inventory of about 20 tons, and required an air rate of about 10,000 scfm. In-situ solids mixing was measured by injecting a tracer into the top of the spent catalyst riser and measuring its concentration in the lower stage as a function of time. An example of typical data is shown in FIG. 9 which plots the concentration of tracer in the lower regenerator stage as a function of time. The raw data were analyzed in a 2-CSTR mathematical model to calculate the backmixing flux. As shown in FIG. 9, the 2-CSTR model provided an excellent fit of the data, verifying our assumptions of the hydrodynamic characteristics of the baffled bed. Particle velocity was measured by a dual fiber optic probe cross-correlation technique. Gas mixing was measured using a helium tracer injected for 1–2 seconds in the aeration air grid at about 0.3 vol %. Entrainment of catalyst in the dilute phase was measured by the accumulation rate in the cyclone dipleg, as well as by pressure transducer system. Bed density and density profile were also measured by pressure transducer system.

The present baffle provided an unexpected result; it reduced entrainment of catalyst into the dilute phase. Repeated studies confirmed that entrainment was reduced by 57% compared to the catalyst distributor alone without the baffle. This significant drop in catalyst entrainment can be expected to reduce both catalyst losses from the regenerator and regenerator cyclone wear. Although the mechanism for the reduction in entrainment is not completely understood, we observed that the bubbles erupting at the surface of the bed were significantly smaller with the baffle installed. Smaller bubbles may lessen the quantity of catalyst launched into the dilute phase.

The catalyst density profiles in the regenerator bed showed that the baffle did not interfere with catalyst circulation. It was tested over a wide range of catalyst circulation rates and superficial air velocities. The baffle had no effect on the catalyst density profiles, confirming the observations in the small-scale model. Even at catalyst circulation rates well above those encountered in commercial service, we were unable to flood the baffle or disrupt catalyst flow in any way. Although its unique design effectively restricts backmixing and limits bubble size, the preferred baffle has a very high percentage of open area (greater than 90%), giving it excellent flow characteristics.

Further tests were conducted to simulate an abrupt shutdown of the air blower. Under these conditions, catalyst quickly drained through the baffle. Refluidization of the bed was accomplished without incident in repeated tests. The baffle is mechanically sturdy and can be easily mounted inside the regenerator.

EXAMPLE 3

Based on the solids mixing and hydrodynamic data obtained in the large-scale model, we used the regenerator model described in Sapre et al., "FCC Regenerator Flow Model," *Chemical Engineering Science,* vol. 45, no. 8, pp. 2203–2209 (1990) to simulate the baffled regenerator's combustion performance. This rigorous kinetic model allowed us to divide the regenerator into any number of stages or "cells" and provide complete specification of gas and catalyst flow between cells. Comparisons of model predictions to commercial operation have shown the model is a useful tool for both regenerator design and analysis.

Once the experimentally-determined backmixing fluxes and other operating data were input, the model was suitable for predicting such key parameters as carbon-on-regenerated catalyst, bed and dilute phase temperatures, and flue gas composition.

The results obtained in the large-scale model show that the baffle of the present invention reduced backmixing in a partial burn regenerator with a bed temperature of 1300° F. and a $CO_2$/CO ratio of 2.66, by more than 81%. At this level of backmixing, the regenerator kinetic model verifies that the system achieves staged combustion in a single regenerator and burned catalyst clean in a partial CO combustion environment.

An unexpected result was the reduction of $NO_x$ in the flue gas discharged from the regenerator. Operation with the baffle reduced $NO_x$ emissions by more than 50% relative to the unbaffled regenerator.

EXAMPLE 4

The large-scale regenerator model of Example 2 was operated with and without a 2-foot thick baffle at different superficial gas velocities to determine the backmixing flux in the regenerator. The results are presented in Table 1.

TABLE 1

| Test | Superficial Velocity (ft/s) | Baffle | Relative Backmixing Flux |
|---|---|---|---|
| A | 1.6 | No | 79 |
| B | 1.8 | No | 84 |
| C | 2.8 | No | 89 |
| D | 2.9 | No | 92 |
| E | 3.3 | No | 100 |
| F | 1.8 | 24" | 19 |
| G | 2.8 | 24" | 19 |
| H | 2.9 | 24" | 18 |
| I | 3.0 | 24" | 19 |
| J | 3.9 | 24" | 32 |

The data show that the solids vertical backmixing rate for the unbaffled regenerator bed was 100 percent of base at regenerator design operating conditions (3.3 ft/s; no baffle), but dropped to 79 percent of base when the superficial gas velocity was reduced to 1.6 ft/s. It is possible that the data for the unbaffled regenerator were scattered more than in the baffled regenerator due to the larger bubbles and higher-pressure fluctuation. The backmixing in the baffled regenerator was around 18–19 percent of base over the design gas superficial velocity range of about 1.8–3 ft/s, and was on the same order as the bulk or net flux of catalyst down through the regenerator bed. The only slight decrement of backmixing flux in the baffled regenerator while going from 3 ft/s to 1.8 ft/s gas superficial velocity can be explained by the possibility of the baffle dampening the effect of gas mixing on solids backmixing. The increase in backmixing as the gas velocity is increased is consistent with other data reported in the art.

EXAMPLE 5

To verify the "robust" behavior of the 24" baffle in the regenerator, a "Robustness" test was conducted in the large regenerator model of Example 2. At normal design operating condition, the air to the regenerator bed with the 24" deep baffle was instantaneously turned off. After the bed was fully defluidized (about 10 minutes), the bed was restarted to normal operating superficial velocity of 3 fps. The bed densities in the regenerator were recorded before slumping the bed and after restarting the compressor.

It was found that most catalyst drained from the upper stage to the lower stage during the defluidizing of the bed. The axial bed density profiles are the same, indicating that the bed can be fully refluidized, and that the system is robust in this respect. It was also confirmed that neither in the large 5-foot unit of Example 2 nor in the small 8-inch unit of Example 1, were there any other flow problems, like flooding, channeling or plugging with the baffle.

EXAMPLE 6

Two different bed split ratios, 50% top/50% bottom and 65% top/35% bottom, were simulated using the simulator model of Example 3. The regenerator geometry and operating conditions used for the simulation are listed in Table 2 below:

TABLE 2

| Case | 5A | 5B |
|---|---|---|
| Bed level | Base | Base |
| Bed split (top %/bottom %) | 50/50 | 65/35 |
| Combustion air rate | Base | Base |
| Catalyst circulation rate | Base | Base |
| Delta carbon | Base | Base |
| Total catalyst inventory | Base | Base |
| Upper bed diameter (ft) | 30 | 30 |
| Backmixing flux inhibition required for dean burn (%) | 96 | 73 |

Figure 11:
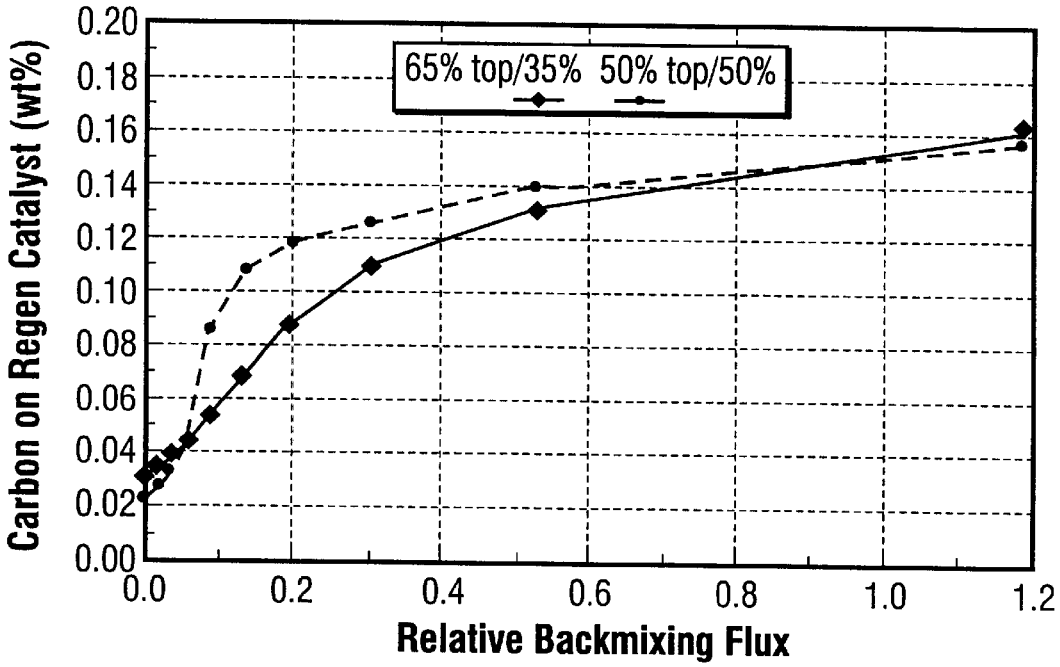
FIG. 11 plots carbon on regenerated catalyst versus backmixing lux for different bed split ratios.

FIG. 11 illustrates simulated CRC (carbon on regenerated catalyst) level versus the backmixing rate in the regenerator. At a bed split ratio of 50% top/50% bottom, a backmixing flux inhibition of 90 percent was required to burn the catalyst clean (with CRC level<0.1 wt %). However, just 73 percent inhibition of backmixing flux could be tolerated to burn catalyst clean at a $CO_2$/CO ratio of 6.33 as the top bed catalyst inventory reached 65%. So, the baffle is most preferably installed at the location having more than 65% catalyst in the top bed in order to burn the catalyst clean.

EXAMPLE 7

The simulation results of more than 20 case studies using the regenerator kinetic model of Example 3, provided enough quantitative data to draw the conclusion that the baffle system can successfully accomplish the technical goals of a simple two-stage, single-regenerator-vessel/FCC catalyst regeneration in partial CO combustion mode. With the baffled regenerator of this invention, the catalyst can be burned clean while operating the regenerator in partial CO combustion mode. The bottom bed diameter used for the following simulations was 24 ft and the bed level was 17 ft. However, a typical conventional complete-combustion regenerator bed may have a 27 ft bottom bed diameter and a 13 ft bed level. Table 3 presents the preferred regenerator configurations and operating conditions used for designing baffled (partial combustion) and unbaffled (complete combustion) regenerators:

TABLE 3

| Regenerator Type | Baffled Regenerator Design | Conventional Regenerator Design |
|---|---|---|
| Bed level | Base + 30% | Base |
| Bed diameter of bottom bed | Base − 11% | Base |
| Catalyst inventory | Base | Base |
| Combustion air rate | Base − 20% | Base |
| Superficial vapor velocity | Base | Base |
| $CO_2$/CO ratio | 2.66 | Complete combustion |
| Delta carbon | Base | Base |

TABLE 3-continued

| Regenerator Type | Baffled Regenerator Design | Conventional Regenerator Design |
|---|---|---|
| % of bed above/below baffle | 65/35 | No baffle |
| Catalyst cooler (MMBtu/hr) | 0 | 52.5 |
| Bottom bed temperature | Base | Base |
| Catalyst circulation rate | Base | Base |
| Carbon on regen catalyst (wt %) | ≦0.05 | ≦0.05 |
| Catalyst makeup rate | Base − 10% | Base |
| $NO_x$ emissions | Base − 50% | Base |

EXAMPLE 8

Figure 12:
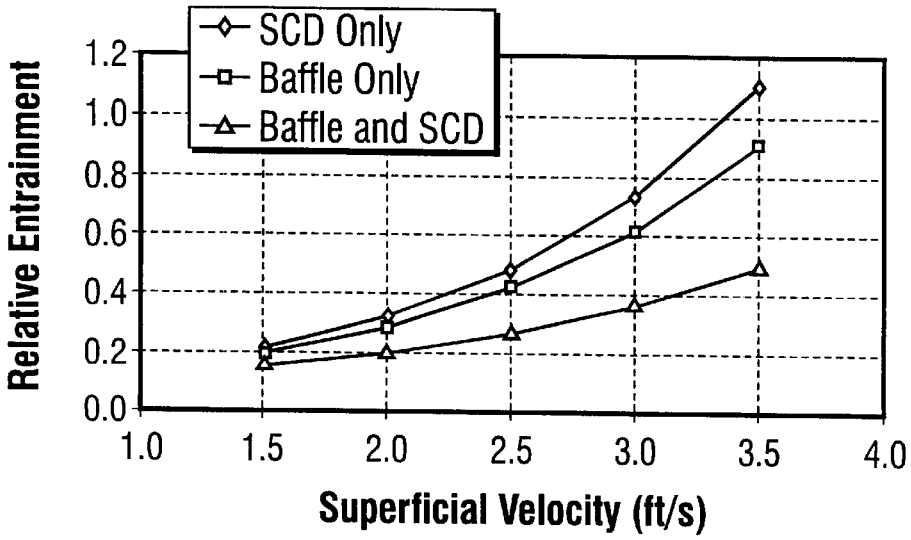
FIG. 12 plots relative entrainment of catalyst into the dilute phase of the regenerator as a function of superficial vapor velocity with the spent catalyst distributor (SCD) alone (♦-♦-♦), the baffle alone (■-■-■) and the baffle/SCD together (▲-▲-▲).

In this example, the large cold flow model of Example 2 was operated with a superficial vapor velocity varied from about 1.5 to about 3.5 ft/s. Entrainment of catalyst in the dilute phase was measured by manometer readings near the regenerator cyclone inlets. The regenerator model was operated with a spent catalyst distributor (SCD) only, with the 24 inch baffle only and with both a baffle and SCD. The results are presented graphically in FIG. 12. When the baffle and SCD are both used, the entrainment is surprisingly reduced much more than can be obtained with either the baffle or the SCD alone.

EXAMPLE 9

Figure 1:
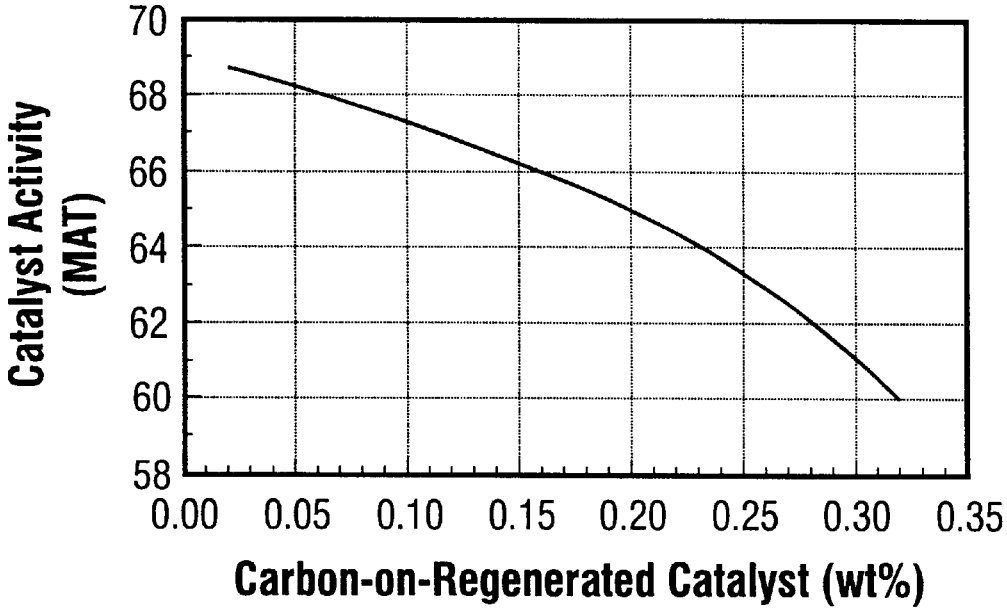
FIG. 1 is a plot of catalyst activity (MAT) as a function of the carbon remaining on the regenerated catalyst.
Figure 10:
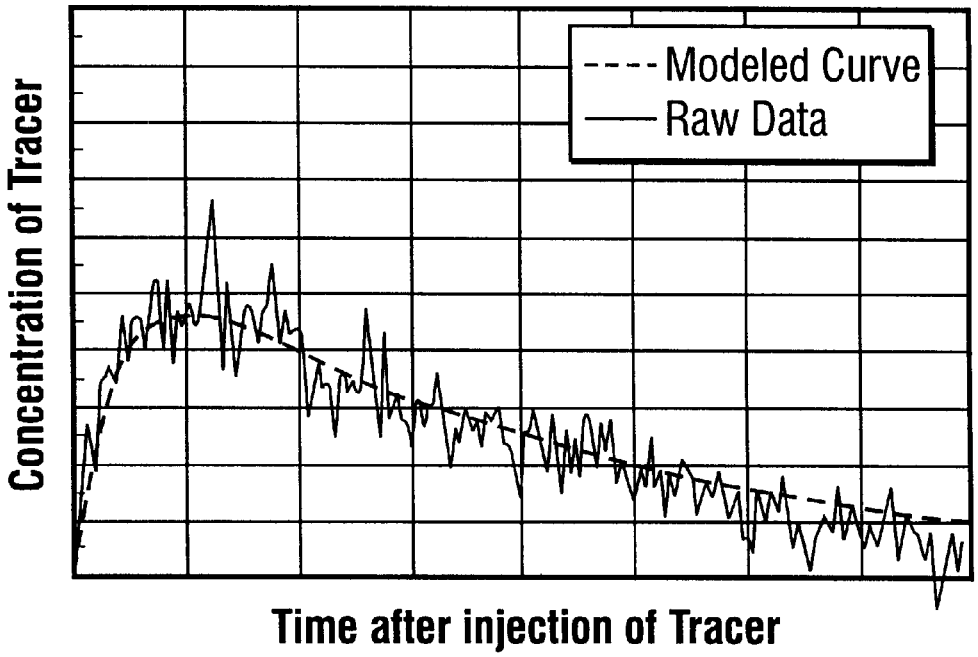
FIG. 10 shows an example of in-situ solids mixing data which plots the concentration of tracer in the lower regenerator bed of the present invention as a function of time.

In this example, we simulated operation of the regenerator in partial combustion mode ($CO_2$/CO ratio 2.66) using the regenerator kinetic model of Example 3 to compare operation with a baffle and spent catalyst distributor (SCD) together, with the baffle alone, and with the SCD alone. The catalyst bed level, catalyst inventory, combustion air rate, superficial vapor velocity, the bed split ratio in the baffle/SCD and baffle only cases (65% top/35% bottom), and catalyst circulation rate were the same in all three simulations. No catalyst cooler was required. The baffle/SCD simulation was able to burn the catalyst clean to a carbon on regenerated catalyst (CRC) of 0.05 wt %, while the baffle only and SCD only cases resulted in CRC levels of 0.11 wt % and 0.20 wt %, respectively. The regenerated catalyst for the baffle only and SCD only cases would have correspondingly much lower activity (MAT) than the baffle/SCD regenerated catalyst (see FIG. 1).

EXAMPLE 10

In this example, the kinetic simulator of Example 3 was used to study an existing FCC regenerator originally designed to process a VGO feedstock. The regenerator had a spent catalyst distributor (SCD), but no baffle. The regenerator operated in complete combustion mode to obtain cleanly burned catalyst. After the FCC unit was built, the refiner increased the Conradson Carbon content of the feedstock from 1% to 3%, and the air blower was increased to its maximum limit. This base case operation is shown in the first column of Table 4 below.

TABLE 4

| Regenerator Type | Complete Combustion, Base Feedstock | Incomplete Combustion, Heavier Feedstock | Incomplete Combustion, Heavier Feedstock, With Baffle in Regen |
|---|---|---|---|
| Conradson Carbon in feed, wt % | 3.0 | 5.0 | 5.0 |
| CO combustion mode | Complete | Partial | Partial |
| Spent catalyst distributor | Yes | Yes | Yes |
| % of bed above/below baffle | No baffle | No baffle | 65/35 |
| Bed level | Base | Base | Base |
| Catalyst inventory | Base | Base | Base |
| Combustion air rate | Base | Base | Base |
| Superficial velocity | Base | Base | Base |
| Catalyst circulation rate | Base | Base | Base |
| Carbon on regenerated catalyst, wt % | 0.05 | 0.20 | 0.05 |
| MAT activity of regenerated catalyst, vol % | Base | Base −4 | Base |

To increase the Conradson Carbon content any further, say to 5%, would require that the unit switch from a complete CO combustion mode into a partial combustion mode. In the second column of Table 4, we show what would happen if the heavier feedstock were processed and the unit dropped into a partial combustion mode. The carbon on regenerated catalyst would increase to about 0.20 wt %. This would reduce the catalytic activity of the regenerated catalyst by about 4 vol %—a significant loss in activity that would adversely affect the yields of desired products such as gasoline.

In the last column of Table 4 we show what would happen if a baffle were added to the unit and the unit were operated at the same conditions as shown in the middle column. The addition of the baffle allows the catalyst to be burned to the same level of carbon as was previously achieved with the lighter feedstock modeled in the first column.

The above description and examples are merely illustrative of the invention and should not be construed as limiting the scope of the invention. Various modifications will become apparent to the skilled artisan in view of the foregoing disclosure. It is intended that all such modifications coming within the scope and spirit of the appended claims should be embraced thereby.

What is claimed is:

1. A catalyst regenerator for removing carbon from spent fluid catalytic cracking (FCC) catalyst circulated in an FCC unit, comprising:

a vessel comprising a dilute phase bed and a dense phase bed of fluidized catalyst disposed in respective upper and lower regions of the vessel, wherein the catalyst comprises spent FCC catalyst having carbon deposited thereon;

a spent catalyst distributor for distributing spent catalyst feed to the vessel;

an air grid disposed adjacent a bottom of the dense phase fluidized catalyst bed for introducing oxygen-containing aeration fluid into the vessel;

a baffle having a vertical midpoint disposed between the spent catalyst distributor and the air grid;

an upper portion of the dense phase fluidized catalyst bed disposed above the vertical midpoint of the baffle and comprising at least 40 percent of the catalyst in the dense phase fluidized catalyst bed comprising a top portion of the dense phase fluidized catalyst bed, wherein the dense phase fluidized catalyst bed is free from oxygen-containing gas inlets above the baffle and wherein the spent catalyst distributor is positioned to distribute the spent catalyst feed onto the top of the dense phase fluidized catalyst bed;

a line connected to an upper region of the vessel for discharging aeration fluid from the dilute phase;

a line connected to a lower region of the vessel for withdrawing regenerated catalyst from the dense bed.

2. The catalyst regenerator of claim 1 wherein the aeration fluid discharge line contains CO and is essentially free of molecular oxygen.

3. The catalyst regenerator of claim 1 wherein the spent catalyst distributor comprises a plurality of aerated trough arms radiating outwardly from a central pipe or well.

4. The catalyst regenerator of claim 1 wherein the upper portion of the dense phase bed comprises at least 60 percent of the catalyst in the dense phase bed.

5. The catalyst regenerator of claim 1 wherein the baffle comprises a structured baffle made from corrugated angularly offset metal sheets.

6. The catalyst regenerator of claim 5 wherein the baffle is at least 6 inches thick.

7. The catalyst regenerator of claim 5 wherein the baffle has a thickness of 2 feet or more.

8. The catalyst regenerator of claim 1 wherein the dense phase fluidized bed is free from spent catalyst introduction inlets below the spent catalyst distributor.

9. The catalyst regenerator of claim 1 wherein the upper portion of the dense phase fluidized bed is unbaffled between the spent catalyst distributor and the midpoint baffle to form two distinct fluidized bed portions for two-staged configuration.

10. The catalyst regenerator of claim 1 wherein the dense phase fluidized bed is isolated from heat transfer surfaces for essentially adiabatic operation.

11. A method of using the catalyst regenerator of claim 1 to remove carbon from spent fluid catalytic cracking (FCC) catalyst circulated in a FCC unit, comprising:

maintaining the dilute phase bed and the dense phase bed of fluidized catalyst in the respective upper and lower regions of the catalyst regenerator vessel, wherein the catalyst comprises spent FOC catalyst having carbon deposited thereon;

distributing spent catalyst feed to the vessel adjacent a top of the dense phase fluidized catalyst bed via the spent catalyst distributor;

introducing oxygen-containing aeration fluid into the vessel adjacent the bottom of the dense phase fluidized catalyst bed via the air grid;

maintaining at least 40 percent of the catalyst in the dense phase fluidized catalyst bed in an upper portion of the dense phase fluidized bed disposed above the vertical midpoint of the baffle;

discharging aeration fluid from the dilute phase through the line connected to the upper region of the vessel;

withdrawing regenerated catalyst from the dense bed through the line connected to the lower region of the vessel.

12. The method of claim 11 wherein the discharged aeration fluid contains CO and is essentially free of molecular oxygen.

13. The method of claim 11 wherein the dense phase fluidized bed is essentially adiabatic.

14. A method of using the catalyst regenerator of claim 1 to remove carbon from spent fluid catalytic cracking (FCC) catalyst circulated in a FCC unit, comprising:

continuously maintaining the dilute phase bed and the dense phase bed of fluidized catalyst In respective upper and lower regions of the catalyst regenerator vessel for two-stage operation, wherein the catalyst comprises spent FCC catalyst having carbon deposited thereon;

distributing spent catalyst teed to the vessel adjacent the top of the dense phase fluidized catalyst bed via the spent catalyst distributor;

introducing oxygen-containing aeration fluid into the vessel adjacent the bottom of the dense phase fluidized catalyst bed via the air grid to establish a superficial vapor velocity from about 1.5 to about 3.5 feet per second;

maintaining at least 40 percent of the catalyst in the dense phase fluidized catalyst bed in the upper portion of the dense phase fluidized bed disposed above the vertical midpoint of the baffle; and discharging aeration fluid Jean in entrained solids from the dilute phase through the line connected to the upper region of the vessel;

withdrawing regenerated catalyst from the dense bed through the line connected to the lower region of the vessel.

15. A method of using the catalyst regenerator of claim 2 to remove carbon from spent fluid catalytic cracking (FCC) catalyst circulated in a FCC unit, comprising:

continuously maintaining the dilute phase bed and the dense phase bed of fluidized catalyst in respective upper and lower regions of the catalyst regenerator vessel for two-stage operation, wherein the catalyst comprises spent FCC catalyst having carbon deposited thereon:

distributing spent catalyst reed to the vessel adjacent a top of the dense phase fluidized catalyst bed via the spent catalyst distributor;

introducing oxygen-containing aeration fluid into the vessel adjacent a bottom of the dense phase fluidized catalyst bed via the air grid;

maintaining at least 40 percent of the catalyst in the dense phase fluidized catalyst bed in an upper portion of the dense phase fluidized bed disposed above the vertical midpoint of the baffle;

discharging aeration fluid from the dilute phase through the line connected to the upper region of the vessel, wherein the discharged aeration fluid contains CO and is essentially free of molecular oxygen;

withdrawing regenerated catalyst from the dense bed through the line connected to the lower region of the vessel.

16. A method of using the catalyst regenerator of claim 4 to remove carbon from spent fluid catalytic cracking (FCC) catalyst circulated in a FCC unit, comprising:

continuously maintaining the dilute phase bed and the dense phase bed of fluidized catalyst in respective upper and lower regions of the catalyst regenerator vessel for two-stage operation, wherein the catalyst comprises spent FCC catalyst having carbon deposited thereon;

distributing spent catalyst feed to the vessel adjacent the top of the dense phase fluidized catalyst bed via the spent catalyst distributor;

introducing oxygen-containing aeration fluid into the vessel adjacent the bottom of the dense phase fluidized catalyst bed via the air grid;

maintaining at least 60 percent of the catalyst in the dense phase fluidized catalyst bed in the upper portion of the dense phase fluidized bed disposed above the vertical midpoint of the baffle;

discharging aeration fluid from the dilute phase through the line connected to the upper region of the vessel, wherein the discharged aeration fluid contains CO and is essentially free of molecular oxygen;

withdrawing regenerated catalyst from the dense bed through the line connected to the lower region of the vessel.

17. A catalyst regenerator for removing carbon from spent fluid catalytic cracking (FCC) catalyst circulated in an FCC unit, comprising:

a vessel comprising a dilute phase and a dense phase fluidized catalyst bed disposed in respective upper and lower regions of the vessel;

a spent catalyst distributor for evenly distributing spent catalyst feed to the vessel and positioned to distribute the spent catalyst feed onto the top of the dense phase fluidized catalyst bed;

an air grid disposed adjacent a bottom of the dense phase fluidized catalyst bed for introducing oxygen-containing aeration fluid into the vessel;

a baffle disposed between the spent catalyst distributor and the air grid dividing the dense phase fluidized catalyst bed into upper and lower stages, wherein the baffle comprises a catalyst backmixing flux and a net downward flux of catalyst;

wherein the upper stage of the dense phase fluidized catalyst bed is free from oxygen-containing gas inlets above the baffle;

aeration fluid passing from the upper stage into the dilute phase that contains CO and is essentially free of molecular oxygen;

aeration fluid passing from the lower stage into the upper stage that contains molecular oxygen and is essentially free of CO;

a line connected to an upper region of the vessel for discharging aeration fluid from the dilute phase;

a line connected to a lower region of the vessel for withdrawing cleanly burned regenerated catalyst from the dense bed.

18. The regenerator of claim 17 wherein the catalyst backmixing flux across the baffles approximately equal to or less than the net flux of the catalyst passing down through the baffle.

19. The catalyst regenerator of claim 17 wherein the spent catalyst distributor comprises a plurality of aerated trough arms radiating outwardly from a central pipe or well.

20. The catalyst regenerator of claim 17 wherein the dense phase fluidized bed is free from spent catalyst introduction inlets below the spent catalyst distributor.

21. The catalyst regenerator of claim 17 wherein the upper stage is unbaffled between the spent catalyst distributor and the midpoint baffle to form two distinct fluidized bed portions for two-staged configuration.

22. A method of using the catalyst regenerator of claim 17 to remove carbon from spent fluid catalytic cracking (FCC) catalyst circulated in an FCC unit, comprising:

continuously maintaining the dilute phase and the dense phase fluidized catalyst bed in the respective upper and lower regions of the vessel;

evenly distributing spent catalyst feed to the vessel adjacent the top of the dense phase fluidized catalyst bed via the spent catalyst distributor;

introducing oxygen-containing aeration fluid into the vessel adjacent the bottom of the dense phase fluidized catalyst bed via the air grid;

maintaining the catalyst backmixing flux and the net downward flux of catalyst across the baffle disposed between the spent catalyst distributor and the air grid dividing the dense phase bed into upper and lower stages;

passing aeration fluid containing CO and essentially free of molecular oxygen from the upper stage into the dilute phase;

passing aeration fluid that contains molecular oxygen and is essentially free of CO from the lower stage into the upper stage;

discharging aeration fluid from the dilute phase via the line connected to the upper region of the vessel;

withdrawing cleanly burned regenerated catalyst from the dense bed via the line connected to the lower region of the vessel.

23. The method of claim 22 wherein the discharged aeration fluid is lean in entrained solids.

24. A method of using the catalyst regenerator of claim 18 to remove carbon from spent fluid catalytic cracking (FCC) catalyst circulated in an FCC unit, comprising:

continuously maintaining the dilute phase and the dense phase fluidized catalyst bed in the respective upper and lower regions of the vessel;

evenly distributing spent catalyst feed to the vessel adjacent the top of the dense phase fluidized catalyst bed via the spent catalyst distributor;

introducing oxygen-containing aeration fluid into the vessel adjacent the bottom of the dense phase fluidized catalyst bed via the air grid;

maintaining the catalyst backmixing flux and the net downward flux of catalyst across the baffle disposed between the spent catalyst distributor and the air grid dividing the dense phase bed into upper and lower stages, wherein the backmixing flux across the baffle is approximately equal to or less than the net downward flux of the catalyst passing down through the baffle;

passing aeration fluid containing CO and essentially free of molecular oxygen from the upper stage into the dilute phase;

passing aeration fluid that contains molecular oxygen and is essentially free of CO from the lower stage into the upper stage;

discharging aeration fluid from the dilute phase via the line connected to the upper region of the vessel;

withdrawing cleanly burned regenerated catalyst from the dense bed via the line connected to the lower region of the vessel.

25. The method of claim 24 wherein the discharged aeration fluid is lean in entrained solids.

26. A method of using the catalyst regenerator of claim 19 to remove carbon from spent fluid catalytic cracking (FCC) catalyst circulated in an FCC unit, comprising:

continuously maintaining the dilute phase and the dense phase fluidized catalyst bed in the respective upper and lower regions of the vessel;

evenly distributing spent catalyst feed to the vessel adjacent the top of the dense phase fluidized catalyst bed via the spent catalyst distributor;

introducing oxygen-containing aeration fluid into the vessel adjacent the bottom of the dense phase fluidized catalyst bed via the air grid;

maintaining the catalyst backmixing flux and the net downward flux of catalyst across the baffle disposed between the spent catalyst distributor and the air grid dividing the dense phase bed into upper and lower stages;

passing aeration fluid containing CO and essentially free of molecular oxygen from the upper stage into the dilute phase;

passing aeration fluid that contains molecular oxygen and is essentially free of CO from the lower stage into the upper stage;

discharging aeration fluid from the dilute phase via the line connected to the upper region of the vessel;

withdrawing cleanly burned regenerated catalyst from the dense bed via the line connected to the lower region of the vessel.

27. The method of claim 26 wherein the discharged aeration fluid is lean in entrained solids.

28. A catalyst regenerator for removing carbon from spent fluid catalytic cracking (FCC) catalyst circulated in a FCC unit, comprising:

a dilute phase bed and a dense phase bed of fluidized catalyst in respective upper and lower regions of a catalyst regenerator vessel, wherein the catalyst comprises spent FCC catalyst having carbon deposited thereon;

means for distributing spent catalyst teed to the vessel onto a top of the dense phase fluidized catalyst bed via a spent catalyst distributor;

means for introducing oxygen-containing aeration fluid into the vessel adjacent a bottom of the dense phase fluidized catalyst bed via an air grid;

at least 40 percent of the catalyst in the dense phase fluidized catalyst bed in an upper portion of the dense phase fluidized bed disposed above a vertical midpoint of a baffle wherein the dense phase fluidized bed is free from oxygen-containing gas inlets above the baffle;

means for discharging aeration fluid from the dilute phase through a line connected to the upper region of the vessel;

means for withdrawing regenerated catalyst from the dense bed through a fine connected to the lower region of the vessel.

29. A catalyst regenerator for removing carbon from spent fluid catalytic cracking (FCC) catalyst circulated in a FCC unit, comprising:

a dilute phase bed and a dense phase bed of fluidized catalyst in respective upper and lower regions of a catalyst regenerator vessel for two-stage operation, wherein the catalyst comprises spent FCC catalyst having carbon deposited thereon;

means for distributing spent catalyst feed to the vessel onto a top of the dense phase fluidized catalyst bed via a spent catalyst distributor;

means for introducing oxygen-containing aeration fluid into the vessel adjacent a bottom of the dense phase fluidized catalyst bed via an air grid to establish a superficial vapor velocity from about 1.5 to about 3.5 feet per second;

at least 40 percent of the catalyst in the dense phase fluidized catalyst bed in an upper portion of the dense phase fluidized bed disposed above a vertical midpoint of a baffle wherein the dense phase fluidized bed is free from oxygen-containing gas inlets above the baffle;

means for discharging aeration fluid lean in entrained solids from the dilute phase through a line connected to the upper region of the vessel; and means for withdrawing regenerated catalyst from the dense bed through a line connected to a lower region of the vessel.

30. A catalyst regenerator for removing carbon from spent fluid catalytic cracking (FCC) catalyst circulated in a FCC unit, comprising:

a dilute phase bed and a dense phase bed of fluidized catalyst in respective upper and lower regions of a catalyst regenerator vessel for two-stage operation, wherein the catalyst comprises spent FCC catalyst having carbon deposited thereon;

means for distributing spent catalyst teed to the vessel onto a top of the dense phase fluidized catalyst bed via a spent catalyst distributor;

means for introducing oxygen containing aeration fluid into the vessel adjacent a bottom of the dense phase fluidized catalyst bed via an air grid;

at least 40 percent of the catalyst in the dense phase fluidized catalyst bed in an upper portion of the dense phase fluidized bed disposed above a vertical midpoint of a baffle wherein the dense phase fluidized bed is free from oxygen-containing gas inlets above the baffle;

means for discharging aeration fluid from the dilute phase through a line connected to an upper region of the vessel, wherein the discharged aeration fluid contains CO and is essentially free of molecular oxygen;

means for withdrawing regenerated catalyst from the dense bed through, a line connected to the lower region of the vessel.

31. A catalyst regenerator for removing carbon from spent fluid catalytic cracking (FCC) catalyst circulated in a FCC unit, comprising:

a dilute phase bed and a dense phase bed of fluidized catalyst in respective upper and lower regions of a catalyst regenerator vessel for two-stage operation, wherein the catalyst comprises spent FCC catalyst having carbon deposited thereon;

means for distributing spent catalyst feed to the vessel onto a top of the dense phase fluidized catalyst bed via a spent catalyst distributor;

means for introducing oxygen-containing aeration fluid into the vessel adjacent a bottom of the dense phase fluidized catalyst bed via an air grid;

at least 60 percent of the catalyst in the dense phase fluidized catalyst bed in an upper portion of the dense phase fluidized bed disposed above a vertical midpoint of a baffle wherein the dense phase fluidized bed is free from oxygen-containing gas inlets above the baffle;

means for discharging aeration fluid from the dilute phase through a line connected to an upper region of the vessel, wherein the discharged aeration fluid contains CO and is essentially free of molecular oxygen;

means for withdrawing regenerated catalyst from the dense bed through a line connected to the lower region of the vessel.

32. A catalyst regenerator for removing carbon from spent fluid catalytic cracking (FCC) catalyst circulated in an FCC unit, comprising:

a dilute phase and a dense phase fluidized catalyst bed in respective upper and lower regions of a vessel;

means for evenly distributing spent catalyst feed to the vessel onto a top of the dense phase fluidized catalyst bed via a spent catalyst distributor;

means for introducing oxygen-containing aeration fluid into the vessel adjacent a bottom of the dense phase fluidized catalyst bed via an air grid;

a catalyst backmixing flux and a net downward flux of catalyst across a baffle disposed between the spent catalyst distributor and the air grid dividing the dense phase bed into upper and lower stages wherein the dense phase fluidized bed is free from oxygen-containing gas inlets above the baffle;

means for passing aeration fluid containing CO and essentially free of molecular oxygen from the upper stage into the dilute phase;

means for passing aeration fluid that contains molecular oxygen and is essentially free of CO from the lower stage into the upper stage;

means for discharging aeration fluid from the dilute phase via a line connected to an upper region of the vessel;

means for withdrawing cleanly burned regenerated catalyst from the dense bed via a line connected to the lower region of the vessel.

33. The regenerator of claim 32 wherein the discharged aeration fluid is lean in entrained solids, the carbon content of the regenerated catalyst is less than 0.05 percent by weight, and the vessel is essentially adiabatic.

34. A catalyst regenerator for removing carbon from spent fluid catalytic cracking (FCC) catalyst circulated in an FCC unit, comprising:

a dilute phase and a dense phase fluidized catalyst bed in respective upper and lower regions of a vessel;

means for evenly distributing spent catalyst feed to the vessel onto a top of the dense phase fluidized catalyst bed via a spent catalyst distributor;

means for introducing oxygen-containing aeration fluid into the vessel adjacent a bottom of the dense phase fluidized catalyst bed via an air grid;

a catalyst backmixing flux and a net downward flux of catalyst across a baffle disposed between the spent catalyst distributor and the air grid dividing the dense phase bed into upper and lower stages, wherein the backmixing flux across the baffle is approximately equal to or less than the net downward flux of the catalyst passing down through the baffle wherein the dense phase fluidized bed is free from oxygen-containing gas inlets above the baffle;

means for passing aeration fluid containing CO and essentially free of molecular oxygen from the upper stage into the dilute phase;

means for passing aeration fluid that contains molecular oxygen and is essentially free of CO from the lower stage into the upper stage;

means for discharging aeration fluid from the dilute phase via a line connected to an upper region of the vessel;

means for withdrawing cleanly burned regenerated catalyst from the dense bed via a line connected to the lower region of the vessel.

35. The regenerator of claim 34 wherein the discharged aeration fluid is lean in entrained solids, the carbon content of the regenerated catalyst is less than 0.05 percent by weight, and the vessel is essentially adiabatic.

36. A catalyst regenerator for removing carbon from spent fluid catalytic cracking (FCC) catalyst circulated in an FCC unit, comprising:

a dilute phase and a dense phase fluidized catalyst bed in respective upper and lower regions of a vessel;

means for evenly distributing spent catalyst feed to the vessel onto a top of the dense phase fluidized catalyst bed via a spent catalyst distributor;

means for introducing oxygen-containing aeration fluid into the vessel adjacent a bottom of the dense phase fluidized catalyst bed via an air grid;

a catalyst backmixing flux and a net downward flux of catalyst across a baffle disposed between the spent catalyst distributor and the air grid dividing the dense phase bed into upper and lower stages wherein the dense phase fluidized bed is free from oxygen-containing gas inlets above the baffle;

means for passing aeration fluid containing CO and essentially free of molecular oxygen from the upper stage into the dilute phase;

means for passing aeration fluid that contains molecular oxygen and is essentially free of CO from the lower stage into the upper stage;

means for discharging aeration fluid from the dilute phase via a line connected to an upper region of the vessel;

means for withdrawing cleanly burned regenerated catalyst from the dense bed via a line connected to a lower region of the vessel.

37. The regenerator of claim 36 wherein the discharged aeration fluid is lean in entrained solids, the carbon content of the regenerated catalyst is less than 0.05 percent by weight, and the vessel is essentially adiabatic.

* * * * *